US008308458B2

(12) United States Patent
Kettlewell et al.

(10) Patent No.: US 8,308,458 B2
(45) Date of Patent: Nov. 13, 2012

(54) ROTOR ASSEMBLY FOR MULTI-STAGE PUMP

(75) Inventors: Nathan Lee Kettlewell, Worthing (GB); Kenneth John Woolgar-Golds, Hassocks (GB); Allan Edmiston McDiarmid, Troy, MI (US); Glen Trevor Harwood Price, Redhill (GB)

(73) Assignee: Edwards Limited, Crawley, West Sussex (GB)

( * ) Notice: Subject to any disclaimer, the term of this patent is extended or adjusted under 35 U.S.C. 154(b) by 778 days.

(21) Appl. No.: 12/224,277

(22) PCT Filed: Feb. 28, 2007 (Under 37 CFR 1.47)

(86) PCT No.: PCT/GB2007/050088

§ 371 (c)(1), (2), (4) Date: May 20, 2009

(87) PCT Pub. No.: WO2007/099369

PCT Pub. Date: Sep. 7, 2007

(65) Prior Publication Data

US 2009/0311113 A1 Dec. 17, 2009

(30) Foreign Application Priority Data

Mar. 2, 2006 (GB) ..... 0604143.8

(51) Int. Cl.
*F03C 2/00* (2006.01)
*F03C 4/00* (2006.01)
*F04C 2/00* (2006.01)

(52) U.S. Cl. ..... 418/19; 418/9; 418/21; 418/206.1; 418/206.6

(58) Field of Classification Search ..... 418/5, 9, 418/206.1–206.8, 19, 21, 26, 28
See application file for complete search history.

(56) References Cited

U.S. PATENT DOCUMENTS

| | | | |
|---|---|---|---|
| 3,685,928 | A | 8/1972 | Munzinger |
| 4,183,719 | A | 1/1980 | Bozung |
| 6,095,781 | A | 8/2000 | Petersen et al. |
| 2005/0069440 | A1 | 3/2005 | Naito |

FOREIGN PATENT DOCUMENTS

EP 0 800 012 A2 10/1997

OTHER PUBLICATIONS

United Kingdom Search Report of Application No. GB0604143.8; claims searched: 1-29; Date of search: Jul. 3, 2006.

(Continued)

*Primary Examiner* — Theresa Trieu

(57) ABSTRACT

A rotor assembly for a multi-stage pump is provided. The assembly includes a drive shaft, a rotor component and a drive component. The rotor component is located on the drive shaft and includes a rotor element for displacing fluid through the pump when the drive shaft is rotated. The drive component is anchored to the drive shaft and transmits torque from the drive shaft to the rotor component to effect rotation of the rotor component. A sleeve element is integrated with either the drive component or the rotor component and is used to space the rotor element from the drive component. An interface surface is located on the sleeve element for interacting with the other one of the drive component and the rotor component in order to maintain orthogonal alignment between the rotor element and the drive shaft. A driver is provided for transmitting torque between the drive component and the rotor component.

26 Claims, 5 Drawing Sheets

OTHER PUBLICATIONS

PCT Notification of Transmittal of the International Search Report and the Written Opinion of the International Searching Authority, or the Declaration of International Application No. PCT/GB2007/050088; Date of mailing: Jun. 5, 2007.

PCT International Search Report of International Application No. PCT/GB2007/050088; Date of mailing of the International Search Report: Jun. 5, 2007.

PCT Written Opinion of the International Searching Authority of International Application No. PCT/GB2007/050088; Date of mailing: Jun. 5, 2007.

ROTOR ASSEMBLY FOR MULTI-STAGE PUMP

FIELD OF THE INVENTION

This invention relates to a rotor assembly for a multi stage vacuum pump.

BACKGROUND OF THE INVENTION

In a conventional multi stage vacuum pump, the rotor assembly comprises two sets of rotor components that are each mounted on a respective one of two drive shafts. The shafts rotate to cause each of the rotor components to interact with a corresponding rotor component mounted on the other drive shaft. The coupling between the drive shaft and the rotor components is key to transmission of the torque therebetween.

One attachment method for coupling the rotor components to the drive shafts involves shrink fitting each rotor component onto a drive shaft. This method provides a secure way of anchoring the rotor component to the drive shaft so that rotation of the drive shaft results in very efficient transmission of the torque to the rotor component. However, if the rotor component deteriorates over time so that its replacement becomes necessary, separation of shrink fitted components can be difficult and time consuming.

An alternative attachment method involves providing a slot or key way into both the rotor component and the drive shaft at corresponding locations, positioning the rotor component on the drive shaft, aligning the rotor component and drive shaft keyways and inserting a key therein. Whilst this method may result in a rotor assembly that is easier to disassemble than that resulting from the aforementioned shrink fitting attachment method, the machining of the key ways is complex and introduces stress concentrators into both the rotor component and the drive shaft.

In each of the aforementioned methods of rotor attachment, angular and orthogonal alignment of the components is critical and not particularly straight forward. It is, therefore, desirable to provide a configuration of rotor component and rotor assembly of reduced complexity and which can be readily disassembled should the need arise.

SUMMARY OF THE INVENTION

According to a first aspect of the present invention there is provided a rotor assembly for a multi-stage pump, the assembly comprising:

a drive shaft;

a rotor component located on the drive shaft, the rotor component comprising a rotor element for displacing fluid through the pump with rotation of the drive shaft;

a drive component anchored to the drive shaft for transmitting torque from the drive shaft to the rotor component to effect rotation thereof;

a sleeve element, integral with one of the drive component and the rotor component, for spacing the rotor element from the drive component;

an interface surface located on the sleeve element for interacting with the other one of the drive component and the rotor component to maintain orthogonal alignment between the rotor element and the drive shaft; and drive means for transmitting torque between the drive component and the rotor component.

By providing the sleeve element as an integral part of either the drive component or the rotor component and by providing an interface surface, improved axial tolerances can be achieved which allow construction of the assembly to be performed without the use of setting and adjustment of each individual component. The drive and rotor components can simply be mounted onto the drive shaft and the axial alignment of the entire rotor assembly can be adjusted axially in relation to stator components that make up the multi-stage pump to achieve the required clearances.

Furthermore, by providing a means for transmitting torque to the rotor component without directly anchoring the rotor component to the drive shaft, the assembly and disassembly of the rotor assembly can be facilitated.

The drive component may comprise a rotor element and may be formed integrally with the drive shaft. Alternatively the drive component may be shrink fitted to the drive shaft or it may be anchored to the drive shaft by a key located in keyways formed in each of the drive shaft and the drive component.

The drive means may be configured to provide a predetermined angular radial alignment between the rotor element of the rotor component and the rotor element of the drive component. The rotor component may be slideably mounted on the drive shaft.

The rotor assembly may comprise locator means for providing a unique mating relationship between the rotor component and the drive component. The locator means may be integral with the drive means or it may be circumferentially spaced from the drive means, for example the locator means may be substantially diametrically opposed to the drive means.

The locator means may comprise a tab located on one of the drive component and the rotor component, and a slot located on the other of the drive component and the rotor component. The drive means may comprise a tab located on one of the drive component and the rotor component, and a slot located on the other of the drive component and the rotor component. One or more tabs and/or one or more slots may be formed on the sleeve element and one or more tabs and/or one or more slots are formed on the rotor element.

The rotor assembly may comprise:

a second rotor component located on the drive shaft, adjacent to the first-mentioned rotor component;

a second sleeve element, integral with one of the rotor components, for mutually spacing the rotor components;

a second interface surface located on the second sleeve element for interacting with the other rotor component to maintain orthogonal alignment between a rotor element of the second rotor component and the drive shaft; and drive means for transmitting torque between the rotor components.

The drive means may be configured to provide a predetermined angular radial alignment between the rotor elements of the rotor components. The rotor assembly may comprise locator means for providing a unique mating relationship between the rotor components.

Therefore, a second aspect of the invention provides a rotor assembly for a multi-stage pump comprising:

a drive shaft;

a drive component located on and anchored to the drive shaft, the drive component comprising a sleeve element extending axially from an anchored portion of the drive component;

a first rotor component located on the drive shaft adjacent to and driveably engaged with the drive component, the first rotor component comprising a rotor element and a sleeve element integral with the rotor element and extending axially from the rotor element; and a second rotor component located on the drive shaft adjacent to and driveably engaged with the first rotor component, wherein each sleeve element comprises an interface surface for interacting with an upstream surface of the adjacent rotor component to maintain orthogonal alignment between each rotor element and the drive shaft.

The drive component may be driveably engaged with the first rotor component by first drive means for transmitting torque between the drive component and the rotor component. The first drive means may comprise a tab located on the sleeve element of the drive component and a slot located on an upstream surface of the rotor element.

The first rotor component may be driveably engaged with the second rotor component by second drive means for transmitting torque between the rotor components. The second drive means may comprise a tab located on the sleeve element of the first rotor component and a slot located on an upstream surface of the second rotor component.

Features described above in relation to the first aspect of the invention are equally applicable to the second aspect and vice versa.

According to a third aspect of the present invention there is provided a rotor component for use in an aforementioned rotor assembly, the rotor component comprising:

a rotor element;

a sleeve element integral with the rotor element;

an interface surface located on the sleeve element for interacting with an adjacent drive component or rotor component to maintain orthogonal alignment between the drive shaft and either the rotor element or a rotor element of an adjacent rotor component; and drive means for receiving torque from an adjacent drive component or rotor component and/or for transmitting torque to an adjacent rotor component.

The sleeve element may extend axially to one side of the rotor element or, alternatively, it may extend axially to both sides of the rotor element. One or more tabs and/or one or more slots may be formed on each opposing axial extreme of the sleeve element.

BRIEF DESCRIPTION OF THE DRAWINGS

An embodiment of the present invention will be described in relation to the following drawings in which.

DETAILED DESCRIPTION OF THE INVENTION

Figure 1:
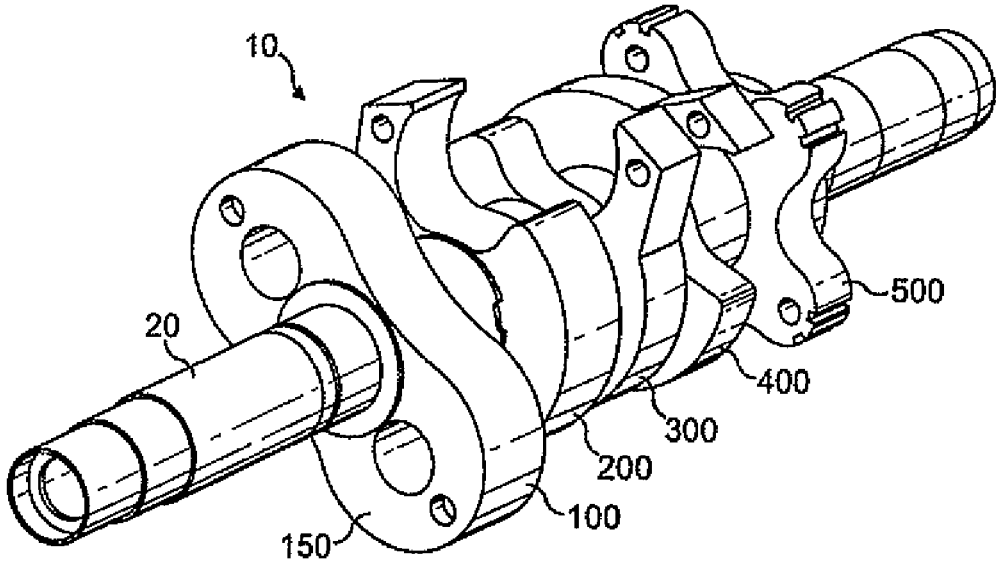
FIG. 1 illustrates an isometric view of a rotor assembly.

A rotor assembly 10 is illustrated in FIG. 1, the rotor assembly comprising a drive shaft 20 upon which are mounted two drive components 100, 500 and a set of rotor components 200, 300, 400. Each drive or rotor component 100, 200, 300, 400, 500 comprises a respective rotor element 110, 210, 310, 410, 510. The rotor element 110 of the first drive component 100 is a two-lobed Roots rotor element, the rotor elements 210, 310, 410 of the rotor components 200, 300, 400 are Northey, or claw, rotor elements and the final rotor element 510 of the second drive component 500 is a five-lobed Roots rotor element.

Figure 2:
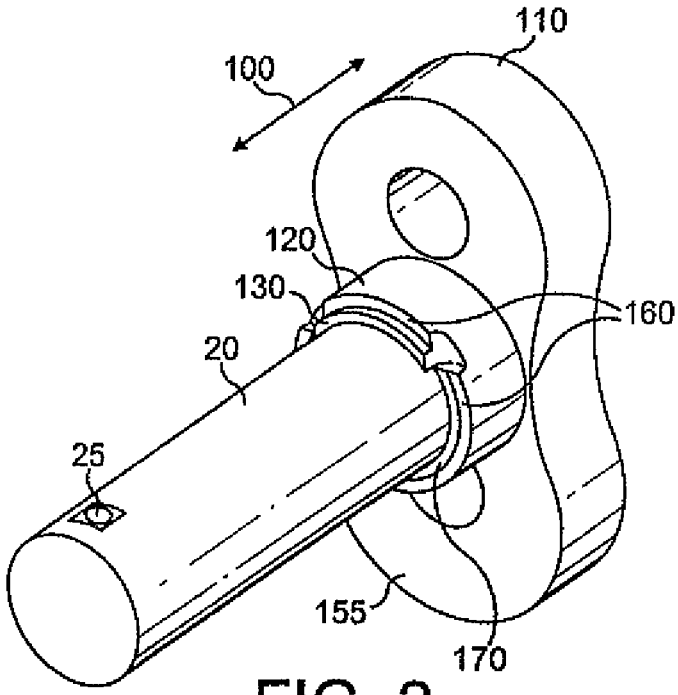
FIG. 2 illustrates a drive shaft and a first drive component of the rotor assembly of FIG. 1.

In this example, the rotor element 110 of the first drive component 100 is formed integrally with the drive shaft 20 as a unitary component. In other words, the drive shaft 20 and the rotor element 110 are machined from a single casting of material. The rotor element 110 has an upstream surface 150 and a downstream surface 155, the latter facing the first rotor component 200. As shown in FIG. 2 a sleeve element 120 extends from the downstream surface 155 of the rotor element 110.

The sleeve element 120 has an axially distal end surface comprising a radially inner surface 170 and a radially outer surface 160 each extending circumferentially about the drive shaft 20. A drive tab 130 extends both axially outwardly from the inner surface 170 and partially about the drive shaft 20. The outer surface 160 is configured to be substantially perpendicular to the longitudinal axis of the drive shaft 20. In other words, the surface 160 is substantially parallel to the plane of the rotor element 110.

Figure 3:
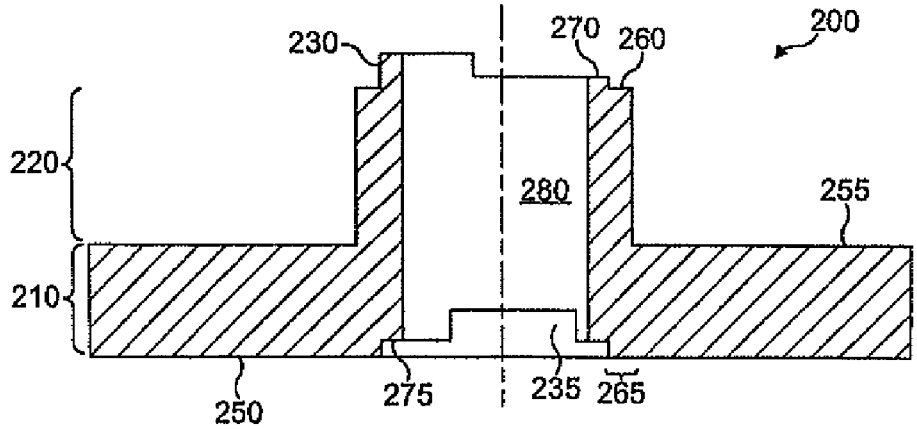
FIG. 3 illustrates a cross-sectional view through a first rotor component of FIG. 1.

FIG. 3 illustrates a cross-sectional view of the first rotor component 200. FIG. 4*a* illustrates a plan view of the upstream surface of the first rotor component 200, and FIG. 4*b* illustrates a plan view of the downstream surface of the first rotor component 200. The first rotor component 200 comprises a rotor element 210 and a sleeve element 220 and is mounted on the drive shaft 20 adjacent to the drive component 100. The sleeve element 220 extends axially from the rotor element 210 as depicted. The rotor element 210 has an upstream surface 250 that is positioned adjacent to the drive component 100 in the assembled rotor assembly 10 of FIG. 1. A drive slot 235 is formed at the radially innermost region 275 of the upstream surface 250. The circumferential dimension of slot 235 corresponds to that of the tab 130 formed on the drive component 100.

The sleeve element 220 of the first rotor component 200 extends from the downstream surface 255 of the first rotor component 200, and has an axially distal end surface comprising a radially inner surface 270 and a radially outer surface 260, similar to that of the sleeve element 120 of the first drive component 100 described above. A drive tab 230 and a locator tab 240 extend axially from inner surface 270 of the sleeve element 220. The locator tab 240 is circumferentially spaced from the drive tab 230. The radially outer surface 260 is external of the tabs 230, 240 and is configured to be substantially parallel to the plane of the rotor element 210.

The first rotor component 200 comprises an axially extending bore 280 passing through the component 200 from the upstream surface 250 to the distal end of the sleeve element 220. The diameter of the bore 280 is chosen to accommodate the drive shaft 20 such that a slide fit may be achieved therebetween upon assembly.

Figure 4:
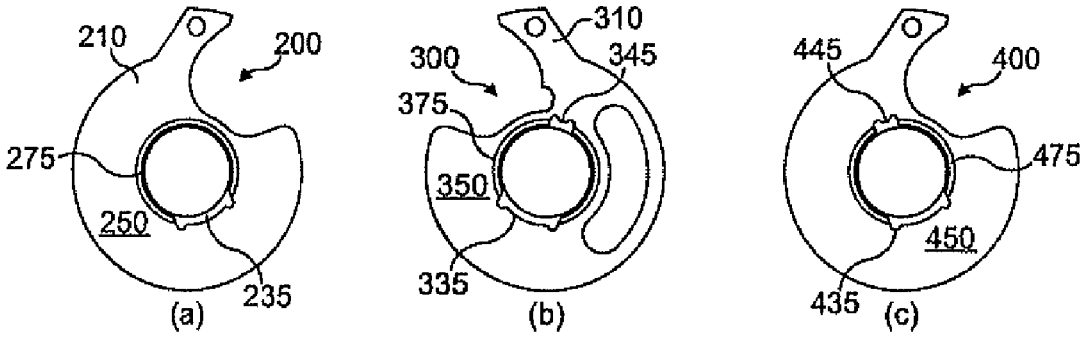
FIG. 4 illustrates upstream faces of each rotor component of FIG. 1.
Figure 5:
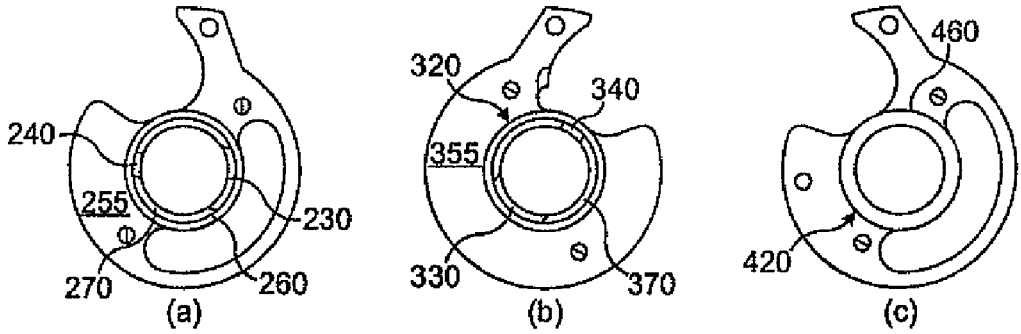
FIG. 5 illustrates downstream faces of each rotor component of FIGS. 1 and 4.

The rotor components 200, 300, 400 are illustrated comparatively in FIGS. 4 and 5. Many of the features on each component are identical and will not be discussed in detail. Rather, the distinctions between the rotor components will be described.

Figure 6:
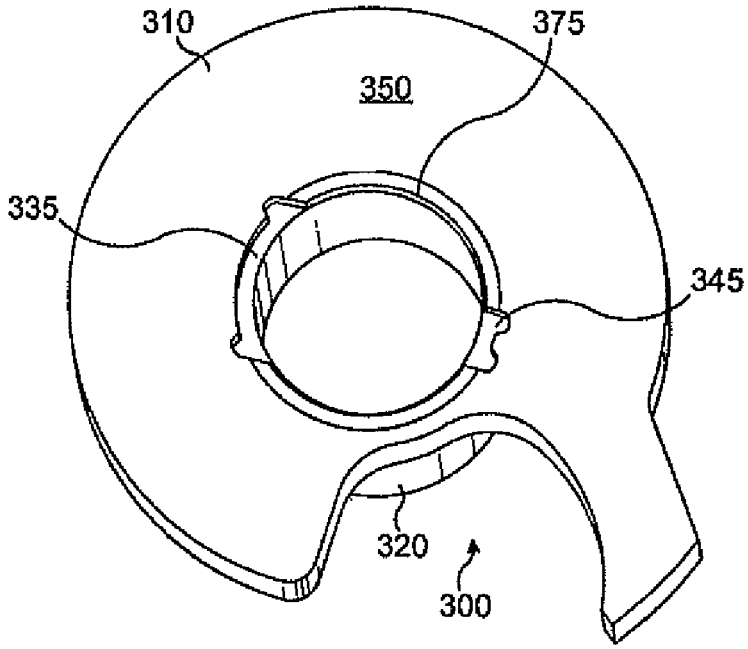
FIG. 6 illustrates an isometric view of an upstream face of a second rotor component of FIG. 1.
Figure 7:
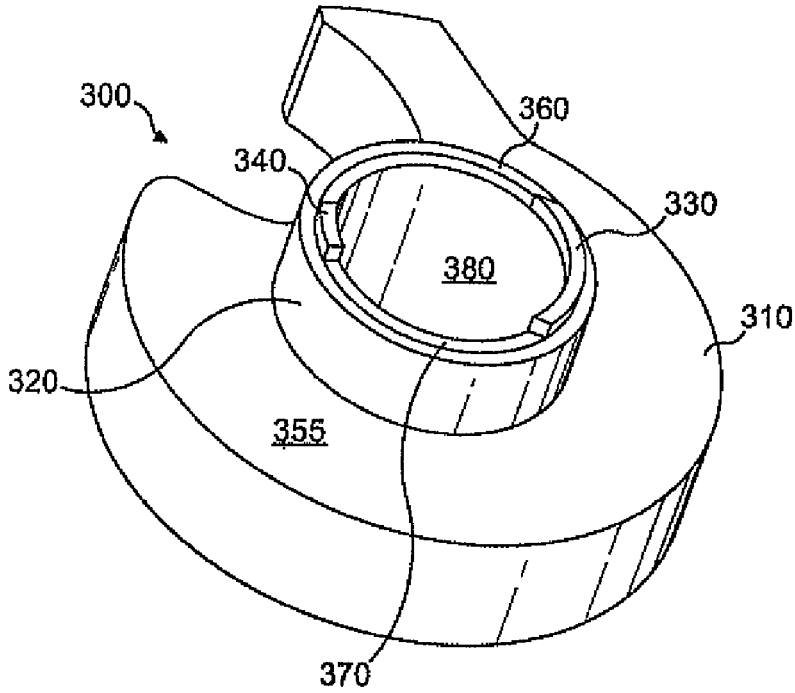
FIG. 7 illustrates an isometric view of a downstream face of the rotor component depicted in FIG. 6.

FIGS. 6 and 7 show isometric views of the second rotor component 300. FIG. 4*b* and FIG. 6 illustrate an upstream surface 350 of the rotor element 310 of the second rotor component 300, and show that a drive slot 335 and a locator slot 345 are formed at a radially innermost portion 375 of the upstream surface 350. The circumferential relative location and dimensions of these slots 335, 345 coincides with those of the tabs 230, 240 formed on the sleeve element 220 of the first rotor component 200.

FIG. 5*b* and FIG. 7 illustrate a downstream surface 355 of the rotor element 310 and show that a drive tab 330 and a locator tab 340 each extend from a radially inner surface 370 of a distal axial end of the sleeve element 320. The relative circumferential location of the tabs 330, 340 is preferably misaligned with that of slots 335, 345 on the upstream surface 350.

The axial thickness of the rotor element 310 of the second rotor component 300 is preferably smaller than that of the rotor element 210 of the first rotor component 200. However, in an alternative embodiment, the thickness may remain the same and the diameter of the rotor element may be altered to effect a change in volume of a pumping capacity of the rotor element.

The third rotor component 400 is largely similar to the first and second rotor components 200, 300. A drive slot 435 and locator slot 445 are formed at the radially innermost portion 475 of the upstream surface 450 of the rotor element 410. Each slot 435, 445 is formed to align with respective drive tab 330 and locator tab 340 formed on the second rotor component 300.

However, no tabs are formed on the distal axial end surface of the sleeve element 420 of the third rotor component 400. Rather, a single circumferentially extending axial surface 460 is provided over the full radial extent of the distal end of the sleeve element 420.

The axial thickness of the rotor element 410 of the third rotor component 400 is preferably smaller than that of the rotor element 310 of the second rotor component 300.

Figure 8:
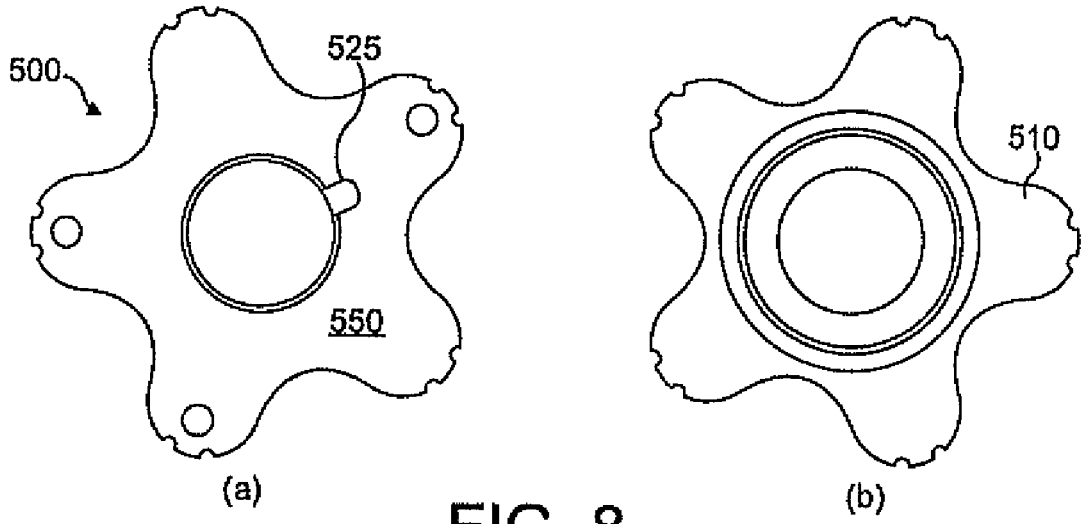
FIG. 8 illustrates an upstream and a downstream face of a second drive component of the rotor assembly of FIG. 1.

The rotor element 510 of the second drive component 500 (illustrated in FIGS. 1 and 8) mounted on the drive shaft 20 is a five-lobed Roots rotor element in the preferred embodiment. The rotor element 510 is fitted to the drive shaft 20 using an interference fit and is therefore directly anchored to the drive shaft 20.

Upon assembly the rotor assembly 10 is located within a stator of a vacuum pump. The vacuum pump comprises a pair of rotor assemblies 10 which, in operation, counter rotate to cause each of the rotor elements mounted on one drive shaft to intermesh with a corresponding rotor element on the other drive shaft. The stator comprises a number of pumping chambers. Once assembled, each pumping chamber accommodates a pair of intermeshing rotor elements. The intermeshing rotor elements act in combination with the surfaces of the associated pumping chamber to displace fluid along the length of the vacuum pump from one pumping chamber to the next.

As discussed above, in the present embodiment the drive component 100 comprises a Roots rotor element 110 and is formed integrally with the drive shaft 20. Consequently, the drive component 100 is anchored securely to the drive shaft 20 so that torque can be transmitted efficiently from the drive shaft 20 to the drive component 100. The first rotor component 200 is mounted on the drive shaft 20, with a slide fit being achieved between the drive shaft 20 and the axial bore 280 of the rotor component 100. The drive slot 235, formed on the upstream face 250 of the rotor component 200, is first aligned with the drive tab 130 formed on the sleeve element 120 of the drive component 100. The rotor component 200 is then moved axially towards the drive component 100 until the drive tab 130 securely engages the drive slot 235.

This configuration permits the radial or lateral positioning of the rotor component 200 to be maintained by the drive shaft 20 but the lack of secure anchoring between the drive shaft 20 and the rotor component 200 substantially prevents any direct transmission of torque from the drive shaft 20 to the rotor component 200. Rather, torque is transmitted to the rotor component 200 through the drive component 100 by the engagement between the drive tab 130 and the drive slot 235, which together serve as a first drive means. In other words the rotor component 200 is indirectly driven by the drive shaft 20.

The relative orientation of adjacent rotor elements 110, 210 establishes the "timing" of the vacuum pump. By providing an intermeshing tab 130 and slot 235 between components 100, 200 a predetermined rotational orientation between the rotor element 110 and the rotor element 210 can be achieved.

Figure 9:
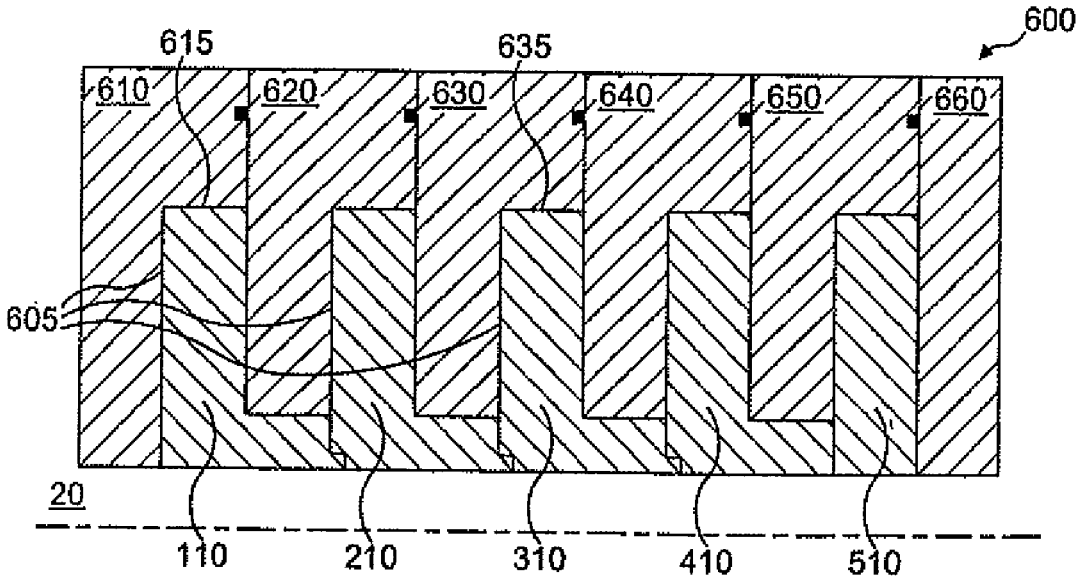
FIG. 9 illustrates a partial longitudinal cross-sectional schematic through a vacuum pump.

FIG. 9 represents a partial longitudinal, vertical, cross-section through a vacuum pump. Each rotor element 110, 210, 310, 410, 510 is located within a pumping chamber 615, 625, 635, 645, 655 defined by stator slices 610, 620, 630, 640, 650 and end plate 660.

Orthogonality, or "squareness" of each rotor element within its respective pumping chamber within the stator must be maintained to achieve a vacuum pump having small clearances 605 which result in minimal leakage whilst avoiding clashing between rotor elements and stator slices. Minimal leakage is required to achieve efficient vacuum pumping performance. Orthogonality of the rotor element 110 with respect to the drive shaft 20, and therefore to the pumping chamber 615, is readily achieved through the machining process as the drive shaft 20 and the drive component 100 are formed as a unitary component. However, it is also desirable to maintain the orthogonality of the rotor component 200 in relation to the respective pumping chamber, and therefore the drive shaft 20. In the preferred embodiment this orthogonality is achieved by the radially outer surface 160 of the sleeve 120 of the drive component 100, which surface provides an axial interface surface for interfacing with an adjacent rotor component 200. Surface 160 is machined with precision to ensure that it is substantially parallel to the plane of the rotor element 110 and therefore orthogonal to the drive shaft 20. Upon assembly, the surface 160 abuts the upstream surface 250 of the first rotor component 200 at a region indicated as 265 in FIG. 3. The upstream surface 250 is preferably finished with precision in order to maintain small clearances 605 with the stator slice 620 which, together with stator slice 630, defines the pumping chamber 615. Consequently, abutment between the radially outer surface 160 and the upstream surface 250 upon assembly results in orthogonality being achieved between the rotor component 200 and the drive shaft 20.

The second rotor component 300 is mounted onto the drive shaft 20 in a very similar manner to that of the first rotor component 200, as described above. The drive slot 335 and the locator slot 345 are aligned to the respective drive tab 230 and locator tab 240 formed on the first rotor component 200. The second rotor component 300 is then moved axially so that the tabs 230, 240 securely engage slots 335, 345. In operation, torque is transmitted to the second rotor component 300 from the drive shaft 20 via the drive component 100 and the first rotor component 200 through the drive means provided by the engagement between respective sets of tabs and slots.

Optionally, as in the preferred embodiment, the circumferential position of the locator tab 240 and locator slot 345 are uniquely spaced from the drive tab 230 and drive slot 335 respectively so that during assembly only the second rotor component 300 can be connected to the first rotor component 200. For example, if the third rotor component 400 were mistakenly mounted adjacent to the first rotor component 200, the slots 435, 445 would not align with the tabs 230, 240 and assembly could not be completed. Consequently, in the preferred embodiment, the rotor assembly 10 can not only achieve the required timing without the need for subsequent adjustment but also the rotor components 200, 300, 400 of the rotor assembly 10 cannot be assembled in the wrong order.

Once assembled the axial interface surface 260 located on the distal end of the sleeve element 220 of the first rotor component 200 abuts region 365 of the upstream face 350 of the second rotor component 300 to achieve and maintain orthogonality between the components 200, 300, and, in turn, the drive shaft 20 and pumping chamber 635.

The third rotor component 400 is mounted onto the drive shaft 20 in a very similar manner to that for the first and second rotor components described above.

The second drive component 500 is subsequently connected to the drive shaft 20, preferably using an interference fit via a pin located in recess 25 (shown in FIG. 2) formed on the drive shaft. A corresponding recess 525 is provided in the upstream surface 550 of the second drive component 500 for engagement with the pin upon assembly. In other words, the second drive component 500 is directly driven by the drive shaft 20 and torque is efficiently transmitted thereto.

Whilst in the preferred embodiment the locator tabs and locator slots are provided as separate features from the drive tabs and drive slots, the drive function and the location function of each cooperating set of tabs and slots may be combined. For example, the drive tab 330 and slot 435 of one cooperating set may be configured so that they differ, say, in arc length from those of each of the other cooperating sets 130;235, 230;335. In other words, the drive tab 130 of the first drive component 100 will only match the drive slot 235 of the first rotor component 200, the drive tab 230 of the first rotor component 200 will only match the drive slot 335 of the second rotor component 300 and so on. In so doing, the overall construction of the rotor assembly 10 can be simplified when compared to the construction of a conventional rotor assembly. Furthermore, as discussed above, the angular orientation or timing of each adjacent, mating pair of components 100;200, 200;300, 300;400 relative to one another may be predetermined. The predetermined orientation can be effected by the unique angular location of the cooperating set (drive tab and slot) in question.

Figure 10:
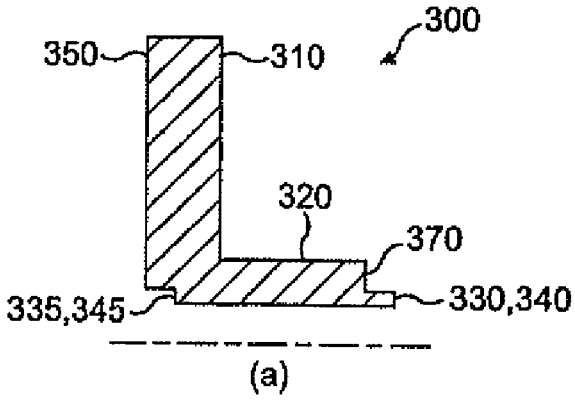
FIG. 10 illustrates a partial cross-sectional schematic of first, second and third embodiments of a rotor component.
Figure 10:
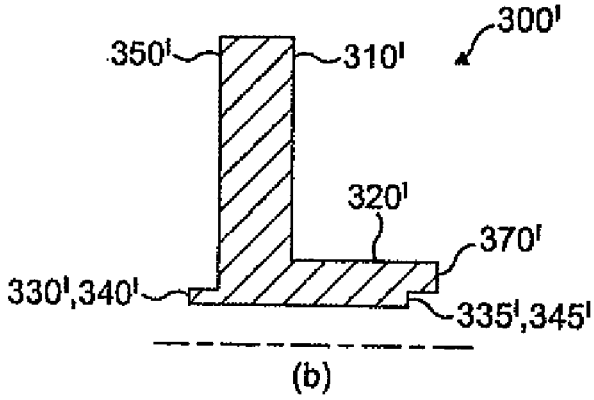
Figure 10:
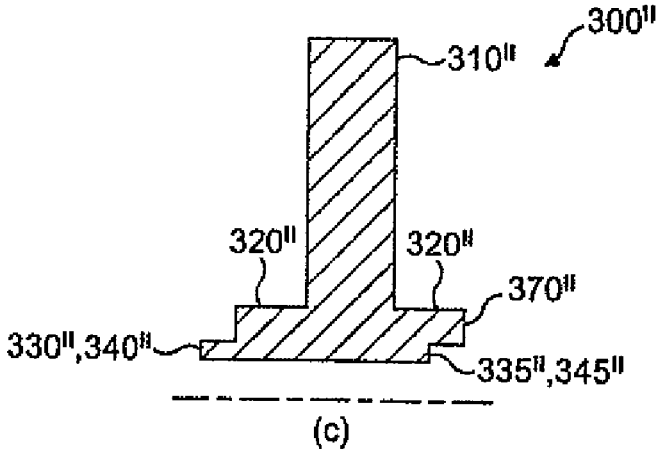

As illustrated in FIG. 10*a*, the drive tabs and locator tabs are preferably provided on a distal axial end surface 170, 270, 370 of each sleeve element 120, 220, 320 and the drive slots and locator slots are provided at a radially innermost region 275, 375, 475 of the upstream surface 250, 350, 450 of the rotor element 210, 310, 410 of the adjacent rotor component 200, 300, 400. However, in an alternative embodiment shown in FIG. 10*b*, the slots may be provided on each sleeve element 120', 220', 320' with the tabs provided on each upstream surface 250', 350', 450' of each rotor element 210', 310', 410' of the adjacent rotor or drive component 200', 300', 400'. In a further embodiment, each sleeve element 220", 320", 420" of a respective rotor component 200", 300", 400" may extend to either side of the rotor element 210", 310", 410" as illustrated in FIG. 10*c*. It should be noted that a combination of slots and tabs can be provided on any distal axial end surface 170, 270, 370 or upstream face 250, 350, 450. For example, a drive tab and a locator slot may be provided on the same surface.

Each drive component 100, 500 is anchored in some way to the drive shaft 20 for the efficient transmission of torque from the drive shaft 20 to the drive components 100, 500. In the preferred embodiment, the first drive component 100 is formed integrally with the drive shaft. Alternatively, in a similar manner to the second drive component 500, the first drive component 100 may be manufactured separately from the drive shaft 20 and connected thereto after manufacture. Connection methods for both the first and second drive components 100, 500 may involve an interference fit, shrink fitting, or forming a keyway or slot into each of the drive component 100, 500 and the drive shaft 20, mounting the drive component onto the drive shaft, aligning the respective keyways to form a single cavity and subsequently inserting a key into the cavity to anchor the drive component 100, 500 and drive shaft 20 together so that rotational alignment is achieved and maintained.

In the preferred embodiment each rotor component 200, 300, 400 is indirectly driven by the drive shaft 20 via drive component 100. In an alternative embodiment, the second drive component 500 may comprise a drive slot, formed at a radially innermost portion of its upstream surface 550, for receiving a drive tab formed at a distal end 470 of the sleeve element 420. The second drive component 500 may thus provide a second path for transmitting torque from the drive shaft 20 to the rotor components 200, 300, 400.

In the preferred embodiment, the first drive component 100 is located upstream of the rotor components 200, 300, 400 and a second drive component 500 is located downstream of the rotor components. However, a single drive component may be provided, which may be located either upstream or downstream of the rotor components. Alternatively, the drive component may be located part way along the drive shaft 20 so that some rotor components are located upstream of the drive component and others are located downstream of the drive component.

Each drive component 100, 500 may comprise a claw rotor element rather than a Roots rotor element as depicted in the preferred embodiment. The drive component 100 need not comprise any rotor element and thus may be configured as a collar which driveably engages with one or more rotor components 200, 300, 400 to cause rotation thereof.

Manufacturing tolerances and variations in fit between the tabs and slots may lead to minimal angular shifts from the nominal location. Additionally, it is possible that over time the closeness of the fit between tabs and slots may further deteriorate, due to wear, leading to further angular shifts from the nominal location. If a rotor component is positioned directly adjacent to a drive component the rotor component is subject to only a single set of cooperating tabs and slots. However, if the rotor component is more remote from the drive component, for example if there are two or three rotor components between the drive component and that rotor component, several cooperating sets of tabs and slots will be located between the drive component and that rotor component. Each cooperating set of tabs and slots may have experienced wear and the minimal angular shift associated with each set has a cumulative effect, as distance from the drive component is increased, which can significantly affect the angular position of the rotor component in question.

Different types of rotor element are able to accommodate different levels of angular play. Intermeshing Roots rotor elements typically require accurate angular alignment in order to avoid clashing of rotor elements whilst keeping leak paths between the rotor elements to a minimum. On the other hand, intermeshing Northey, or claw, rotor elements are typically more tolerant of some degree of angular misalignment. Therefore, if Roots rotor elements are to be incorporated into the rotor assembly 10 it is desirable for them to be located at or adjacent to the drive component or perhaps removed therefrom by only a single rotor component. Claw rotor elements, however, may be located at or adjacent to the drive component or, alternatively, may be located more remotely from the drive component if required.

In the preferred embodiment, the two drive components 100, 500 each comprise multi-lobed Roots rotor elements 110, 510 and the three rotor components 200, 300, 400 each comprise a claw or Northey rotor element 210, 310, 410. However, the number of rotor components and selection of the configuration of the rotor elements is flexible and may be tailored to accommodate the pumping capacity required by any particular application.

In the preferred embodiment, axial interface surfaces are provided by radially outer surfaces 160, 260, 360, 460 which are external to the tabs at the distal end of each sleeve element. The axial interface surfaces are so configured to enable axial accuracy in machining of the tabs to be relaxed, thus reducing the cost of the associated machining process. In other words, by providing a separate surface 160, 260, 360, 460 with no discontinuities present therein, it is easier to machine the surface to a high precision, for example using a grinding technique, than it would be to machine a radially inner surface 170, 270, 370, 470 to the same degree of accuracy such that orthogonality between components may be achieved. If the axial accuracy is relaxed in the tab and slot machining processes the slots can be formed deeper than the axial length of the tabs so that there is no interference between a distal end of the tabs and a base of the slots. Any such interference may potentially cause a pivoting tendency between the two adjacent components in/on which the slots/tabs are formed. By extending the axial depth of the slots any pivoting tendency is avoided.

In the preferred embodiment the axial interface surfaces 160, 260, 360, 460 are formed continuously to entirely surround the drive shaft 20, once assembled. However, orthogonality of adjacent drive and rotor components 100, 200, 300, 400, 500 may still be achieved if each of the axial interface surfaces 160, 260, 360, 460 extends circumferentially about a portion of the drive shaft 20.

In an alternative embodiment, the functionality of ensuring orthogonality between adjacent components may be provided by accurately machining the distal surfaces of the tabs, radially inner surfaces 170, 270, 370, 470 of the sleeve elements and the radially innermost regions 275, 375, 475, 575 of upstream surfaces 250, 350, 450, 550. However, this configuration results in an associated increase in complexity of machining and consequential expense.

Each rotor component 200, 300, 400 may be machined from a single casting of material having an axially extending bore 280, 380, 480 formed therethrough. The combined axial depth of the rotor element 210, 310, 410 and sleeve element 220, 320, 420 is effectively double that of the rotor element 210, 310, 410 when taken alone, as for conventional rotors. This increased axial depth enables the rotor component 200, 300, 400 to be mandrel mounted during manufacture in a stable manner for machining purposes rather than using the flat bed milling techniques that may be used for conventional rotor elements. Supporting the rotor component 200, 300, 400 in this way permits improved engagement to be achieved between the component and the machine which leads to improved concentricity and orthogonality of the machined surfaces. Most of the machining processes may therefore be carried out by a single machine. Consequently, a single datum can be used for all of the processes carried out by the single machine and errors that are typically introduced through setting up the component in different machines are thus eliminated. Accuracy of the dimensions of each of the rotor components 200, 300, 400 can therefore be enhanced.

The machining tolerances achieved on machining any one surface of a component are effectively of a prescribed value. The tolerance value is dependent on the machine tool in question and the speed of cutting undertaken. By replacing two machined components, a rotor and a spacer, with the single rotor component 200, 300, 400, and therefore replacing four axial surfaces by only two axial surfaces, the cumulative build up of any axial tolerances generated through the machining process can therefore be halved. As axial tolerances are improved, the need for axial manipulation in the form of "setting" or "tuning" the rotor components 200, 300, 400 of the rotor assembly 10 during the assembly process can be reduced, if not eliminated.

The earlier description of the assembly of the preferred embodiment focussed entirely on the rotor assembly 10. In practice, the stator of the vacuum pump 600 is assembled concurrently with the rotor assembly 10. A stator slice 610, 620, 630, 640, 650 is positioned onto the drive shaft 20 in between each pair of drive 100, 500 or rotor 200, 300, 400 components, as illustrated in FIG. 9. FIG. 9 shows that the axial clearances 605 between each axial surface of each rotor element 110, 210, 310, 410, 410, 510 and an adjacent stator slice 610, 620, 630, 640, 650 and end plate 660 need to be carefully controlled.

In conventional vacuum pumps the assembly process is very slow as this clearance needs to be set as each stage of assembly takes place. A stage comprises a stator slice and a pair of intermeshing rotor elements. If, in an attempt to speed up the assembly process, the components were simply assembled on the shaft without this formal setting of clearances, the build up of tolerances would lead to significant axial misalignments resulting in clashing between rotor elements and stator slices. A large proportion of pumps, say in the region of 20%, would not even rotate on start up due to the resulting interference between axially adjacent components. An even larger number of pumps would experience clashing of axially adjacent components once the pump started to heat up during operation and thermal expansion occurred. Alternatively the components could be manufactured with greater clearances to avoid any such clashing of components, however, these clearances may introduce leakage paths which, in turn, have a detrimental effect on the performance on the pumping capacity of the pump.

The configuration of the preferred embodiment can enable a faster assembly process to be achieved without the need for a formal setting of clearances on a stage by stage basis. The aforementioned reduction in axial tolerances enables each successive stage to be assembled on to the drive shaft 20 and the position of the rotor assembly 10 to be axially set relative to the stator as a single unit. Consequently, the speed of assembly can be significantly enhanced as the complexity of the assembly process is reduced.

The second drive component 500 requires significant force to be employed for its removal from the drive shaft 20 during disassembly of the vacuum pump. By mounting each of the rotor components 200, 300, 400 on the drive shaft 20 using a slide fit, they can readily be removed from the drive shaft 20. Consequently disassembly of the pump, for servicing and maintenance purposes, is significantly simpler and therefore cheaper and faster.

While the foregoing description and drawings represent the preferred embodiments of the present invention, it will be apparent to those skilled in the art that various changes and modifications may be made therein without departing from the true spirit and scope of the present invention.

We claim:

1. A rotor assembly for a multi-stage pump, the assembly comprising:

a drive shaft;

a rotor component located on the drive shaft, the rotor component comprising a rotor element for displacing fluid through the pump with rotation of the drive shaft;

a drive component anchored to the drive shaft for transmitting torque from the drive shaft to the rotor component to effect rotation thereof;

a sleeve element, integral with one of the drive component and the rotor component, for spacing the rotor element from the drive component;

an interface surface located on the sleeve element for interacting with the other one of the drive component and the rotor component to maintain orthogonal alignment between the rotor element and the drive shaft; and drive means for transmitting torque between the drive component and the rotor component, wherein the rotor component is slideably mounted on the drive shaft.

2. The rotor assembly according to claim 1 wherein the drive component comprises a rotor element.

3. The rotor assembly according to claim 2 wherein the drive means is configured to provide a predetermined angular radial alignment between the rotor element of the rotor component and the rotor element of the drive component.

4. The rotor assembly according to claim 1 wherein the drive component is formed integrally with the drive shaft.

5. The rotor assembly according to claim 1 wherein the drive component is shrink fitted onto the drive shaft.

6. The rotor assembly according to claim 1 wherein the drive component is anchored to the drive shaft by a key located in keyways formed in each of the drive shaft and the drive component.

7. The rotor assembly according to claim 1 comprising locator means for providing a unique mating relationship between the rotor component and the drive component.

8. The rotor assembly according to claim 7 wherein the locator forms part of the drive means.

9. The rotor assembly according to claim 7 wherein the locator means is circumferentially spaced from the drive means.

10. The rotor assembly according to claim 9 wherein the locator means is substantially diametrically opposed to the drive means.

11. The rotor assembly according to claim 7 wherein the locator means comprises a tab located on one of the drive component and the rotor component, and a slot located on the other of the drive component and the rotor component.

12. The rotor assembly according to claim 1 wherein the drive means comprises a tab located on one of the drive component and the rotor component, and a slot located on the other of the drive component and the rotor component.

13. The rotor assembly according to claim 11 wherein one or more tabs and/or and one or more slots are formed on the sleeve element.

14. The rotor assembly according to claim 11 wherein one or more tabs and/or and one or more slots are formed on the rotor element.

15. The rotor assembly according to claim 1 comprising:

a second rotor component located on the drive shaft, adjacent to the first-mentioned rotor component;

a second sleeve element, integral with one of the rotor components, for mutually spacing the rotor components;

a second interface surface located on the second sleeve element for interacting with the other rotor component to maintain orthogonal alignment between a rotor element of the second rotor component and the drive shaft; and drive means for transmitting torque between the rotor components.

16. The rotor assembly according to claim 15 wherein the drive means is configured to provide a predetermined angular radial alignment between the rotor elements of the rotor components.

17. The rotor assembly according to claim 15 wherein the drive means is configured to provide a unique mating relationship between the rotor components.

18. A rotor assembly for a multi-stage pump comprising:

a drive shaft;

a drive component located on and anchored to the drive shaft, the drive component comprising a sleeve element extending axially from an anchored portion of the drive component;

a first rotor component located on the drive shaft adjacent to and driveably engaged with the drive component, the first rotor component comprising a rotor element and a sleeve element integral with the rotor element and extending axially from the rotor element; and a second rotor component located on the drive shaft adjacent to and driveably engaged with the first rotor component;

wherein each sleeve element comprises an interface surface for interacting with an upstream surface of the adjacent rotor component to maintain orthogonal alignment between each rotor element and the drive shaft, wherein the first or second rotor component is slideably mounted on the drive shaft.

19. The rotor assembly according to claim 18 wherein the drive component is driveably engaged with the first rotor component by first drive means for transmitting torque between the drive component and the rotor component.

20. The rotor assembly according to claim 19 wherein the first drive means comprises a tab located on the sleeve element of the drive component and a slot located on an upstream surface of the rotor element.

21. The rotor assembly according to claim 18 wherein the first rotor component is driveably engaged with the second rotor component by second drive means for transmitting torque between the rotor components.

22. The rotor assembly according to claim 21 wherein the second drive means comprises a tab located on the sleeve element of the first rotor component and a slot located on an upstream surface of the second rotor component.

23. The rotor component for use in a rotor assembly of claim 18 the rotor component comprising:

a rotor element;

a sleeve element integral with the rotor element;

an interface surface located on the sleeve element for interacting with an adjacent drive component or rotor component to maintain orthogonal alignment between the drive shaft and either the rotor element or a rotor element of an adjacent rotor component; and drive means for receiving torque from an adjacent drive component or rotor component and for transmitting torque to an adjacent rotor component.

24. The rotor component according to claim 23 wherein the sleeve element extends axially to one side of the rotor element.

25. The rotor component according to claim 23 wherein the sleeve element extends axially to both sides of the rotor element.

26. The rotor component according to claim 25 wherein one or more tabs and one or more slots are formed on each opposing axial extreme of the sleeve element.

* * * * *